United States Patent [19]

Stipkovits

[11] Patent Number: 5,004,033

[45] Date of Patent: Apr. 2, 1991

[54] GAP BRIDGING ASSEMBLY FOR USE WITH VERTICAL BLIND ASSEMBLIES

[76] Inventor: Frank M. Stipkovits, 4584 Lower Mountain Rd., Lockport, N.Y. 14094

[21] Appl. No.: 519,673

[22] Filed: May 4, 1990

[51] Int. Cl.[5] ..... E06B 9/38

[52] U.S. Cl. ..... 160/178.1; 160/39; 160/166.1

[58] Field of Search ..... 160/168.1, 176.1, 178.1, 160/900, 902, 166.1, 172, 173, 38, 39

[56] References Cited

U.S. PATENT DOCUMENTS

| | | | |
|---|---|---|---|
| 4,079,770 | 3/1978 | Woodle | 160/39 X |
| 4,779,661 | 10/1988 | Yalowega | 160/166.1 X |
| 4,828,002 | 5/1989 | Ashby | 160/38 |

*Primary Examiner*—David M. Purol

*Attorney, Agent, or Firm*—Terry M. Gernstein

[57] ABSTRACT

A gap is formed between the vertically oriented slats of a vertical blind assembly and the wall or window associated with such blind assembly. A gap-bridging assembly includes a bracket that supports a vertical vane to move in that gap so that different portions of the gap can be covered as required.

5 Claims, 1 Drawing Sheet

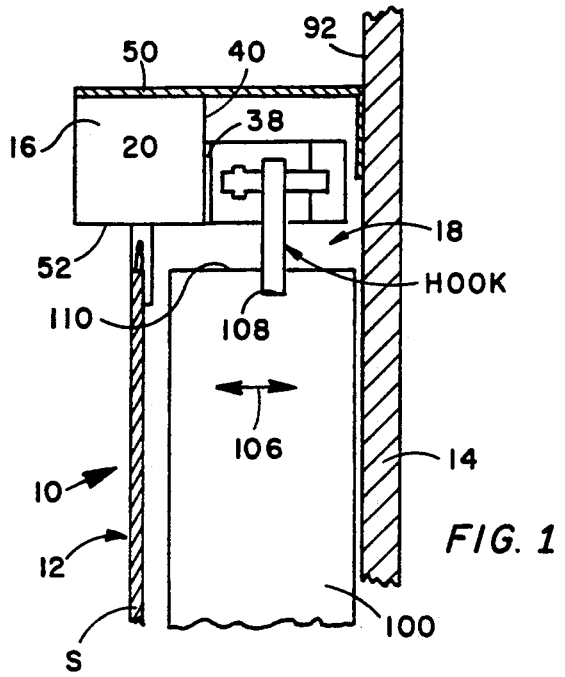
FIG. 1
FIG. 5
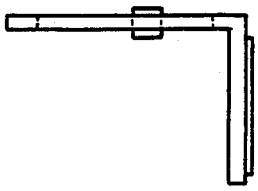
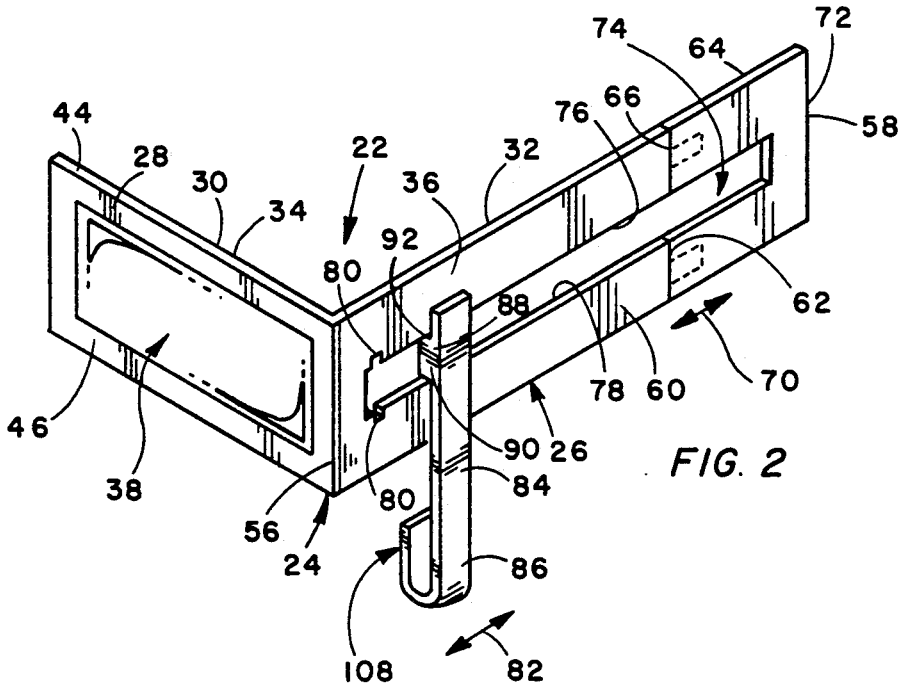
FIG. 2
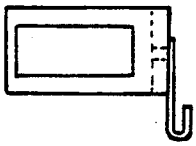
FIG. 4
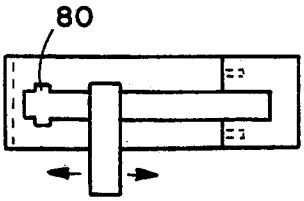
FIG. 3

GAP BRIDGING ASSEMBLY FOR USE WITH VERTICAL BLIND ASSEMBLIES

TECHNICAL FIELD OF THE INVENTION

The present invention relates to the general art of hardware, and to the particular field of hardware used in connection with window blinds.

BACKGROUND OF THE INVENTION

Vertical window blinds are commonly installed as window coverings. These blinds include slats that are attached at one end thereof to a headrail located superadjacent to the window, and extend vertically next to the window.

The headrail is mounted on a wall window frame. When the blinds are installed on such a vertical mount, they may be spaced from the wall, and from the window. Such spacing can be as much as five inches or more.

When the blinds are fully closed, there is a gap between the blinds and the window, and such gap may be troublesome.

While the art contains examples of elements that are intended to close this gap, these elements are generally installed in a manner that prevents them form being moved or adjusted to accommodate a condition that is different from that existing at the time of installation. There are several situations which may require this gap to be adjusted. For example, the sun may shine through this gap at certain times of the day and not at other times. Thus, there may be strong shaft of sunlight entering the room at certain times of the day, while at other times, the room may be too dark.

For several reasons, such as aesthetic, energy conservation, or the like, it may be desirable to close this gap at some times while opening it at others.

Still another reason for desiring adjustability of a gap bridging element is to provide an ability to retofit such an element onto an existing setup. A pre-manufactured item may not provide an exact fit, and thus, movement and adjustment of such an element is desirable.

Many times, a blind assembly must be adjusted after it is installed. Unless there is some means of adjusting the gap bridging element, this element may not be positioned in the precise location that is most desirable.

Therefore, there is a need for a gap bridging element for use with a vertical blind assembly which is adjustable after it is installed.

OBJECT OF THE INVENTION

It is the object of the present invention to provide a gap bridging element for use with a vertical blind assembly which is adjustable after it is installed.

SUMMARY OF THE INVENTION

This, and other, objects are achieved by a gap bridging assembly which includes an L-shaped bracket having an elongated hook movably mounted on the bracket adjacent to the slot. An elongated gap-bridging vane is pendently mounted from the hook and moves therewith to vary the portion of the gap that is covered. The long leg is bipartite and has one portion that is movable with respect to the other to ensure that the bracket fully spans the gap whereby the gap-bridging vane can be moved as necessary. The hook is also removably mounted on the bracket so the vane can be completely removed if desired.

BRIEF DESCRIPTION OF THE FIGURES

FIG. 1 is an elevational view of a gap defined between vertical blinds and a wall and a gap bridging assembly embodying the present invention.

FIG. 2 is a perspective view of a bracket assembly of the present invention.

FIG. 3 is a front elevational view of the bracket assembly.

FIG. 4 is an end elevational view of the bracket assembly.

FIG. 5 is a top plan view of the bracket assembly.

DETAILED DESCRIPTION OF THE PREFERRED EMBODIMENT OF THE INVENTION

Shown in FIG. 1 is a vertical blind set up 10 in which a vertical blind unit 12 is mounted on a wall 14 adjacent to a window (not shown). As shown, the vertical blind set up includes a plurality of vertically oriented slats, such as slat S, pendently supported from a headrail 16 that is fixedly mounted on the wall superadjacent to the window frame.

As can be seen in FIG. 1, the slats are spaced from the wall by a distance that can be as much as five inches or more and thus form a gap 18 between the blinds and the wall or the window. This gap can permit sunlight or drafts to pass into the room, which may be undesirable at certain times and desirable at other times.

Therefore, the present invention includes a gap bridging assembly 20 which permits different portions of this gap 18 to be closed at different times.

The gap bridging assembly 20 includes as bracket assembly 22 that is shown in position in FIG. 1, but is best shown in FIG. 2. Referring to FIG. 2, it is seen that the bracket assembly 22 includes an L-shaped body 24 having a short leg 26 and a long leg 28. The short and long legs have inner surfaces 30 and 32 respectively and outer surfaces 34 and 36 respectively. Adhesive 38 is coated on the short leg outer surface 34 in position to contact back surface 40 of the head rail 16 so that the bracket long leg 26 extends across the gap 18 from that headrail back surface 40 towards front surface 42 of the wall.

The bracket 24 is shown in FIGS. 1 and 2 in an upright position to have a top edge 44 and a bottom edge 46 so that a width dimension is defined between the top and bottom edges. As seen in FIG. 1, the width dimension of the bracket is smaller than the width dimension of the headrail as measured from the top edge 50 thereof to the bottom edge 52 thereof. This will permit the bracket to be positioned on the headrail in the most effective and desirable location.

The long leg 26 includes a length dimension as measured between corner 56 and rear edge 58 and has a width dimension as measured between the top edge 44 and the bottom edge 46 that is equal to the width of the short leg. The length of the long leg is selected to essentially match the width of the gap 18. However, this gap dimension may vary due to installation or the like. Therefore, the bracket 24 includes a means for compensating for any variation in such gap dimension. This means includes a bipartite form of the long leg so that this leg has a first section 60 extending from the corner 56 and ending at an edge 62 and a second section 64 extending from rear edge 58 to an edge 66. The second section 64 is U-shaped with the legs thereof forming continuations of the legs of the first portion so that the overall shape of the long leg is rectangular. The two sections 60 and 64 are slidably coupled together by projections 68 on the edge 62 of the first section 60 slidably fitting into slots defined in the second section from the edge 66 so that the second section can move toward and away from the first section as indicated by double-headed arrow 70 in FIG. 2. The length of long leg is thus adjustable so that the gap 18 can be covered even if the actual gap is larger than expected. Adhesive 72 is located on the edge 58 to attach the long leg to the wall surface 42.

The long leg 26 has an elongated slot 74 defined therein, with the slot including matching portions in both of the long leg sections to form a single continuous slot as shown in FIG. 2. The slot extends from adjacent to the corner 56 to adjacent to the edge 58, and has a width dimension as defined between edges 76 and 78 of the long leg. The long leg includes a pair of recesses 80 defined therein adjacent to the corner 56. The recesses extend perpendicular to the slot 74 and serve a function that will be discussed below.

A J-shaped hook 80 is slidably attached to the long leg to move in the direction indicated by the double-headed arrow 82 which is the direction to traverse the gap 18. The hook 80 includes a top portion 84 and a curved bottom portion 86, with the top portion being located adjacent to the long leg slot and the bottom portion depending therefrom into the gap as shown in FIG. 1. The hook is located adjacent to the long leg outer surface 36 and is slidably attached to the long leg adjacent to the slot by a T-shaped projection 88 having a body 90 attached at one end thereof to the hook top portion 84 and extending through the slot and having a cap 92 located adjacent to the inner surface 32 of the long leg. The cap is larger than the slot width and the projection is longer the thickness of the long leg as measured between the inner and outer surfaces 32 and 36 respectively. Accordingly, the hook is attached to the long leg by the projection 88 but is permitted to slide in the slot 74.

In the event that the hook is to be removed from the bracket, the hook is moved to align the cap 92 with the slots 80 which are sized to permit the cap to slide through the aligned slots. This permits the hook to be disengaged from the bracket.

As is best shown in FIG. 1, the gap-bridging assembly 10 further includes a gap-bridging vane 100 which is similar to the slats S, but is oriented to be essentially perpendicular to a plane containing such slats and a plane containing the wall and is located in the gap 18. The vane 100 has a width as measured between side edges 102 and 104 thereof that is slightly less than the width of the gap as measured between the slats and the wall. The vane can thus be moved in the gap as indicated by the double-headed arrow 106 to position the vane in the most advantageous location within that gap.

The vane includes a hook-receiving slot 108 adjacent to a top end 110 of that vane, and the hook curved bottom portion 86 fits through that slot 108 to pendently attach the vane to the bracket via the hook for movement with the hook.

Operation of the assembly 10 is evident from the foregoing, and therefore will only be briefly discussed. The blind assembly is installed leaving the gap 18. The bracket assembly 24 is then installed by first attaching the adhesive 30 to the headrail surface 40, and then moving the long leg sections until that long leg spans the gap. The long leg edge 58 is then attached to the wall via the adhesive 72, and the hook 80 is inserted into the slot 74 via the slots 80. The gap-bridging vane 100 is attached to the hook via the slot 108 and is positioned in the most suitable location in the gap 18 by moving the hook 80 in the slot 74. Should the need arise, the vane 100 can be completely removed from the gap by moving the hook until the projection cap 92 is aligned with the slots 80 and then simply pulling that cap through these slots.

It is understood that while certain forms of the present invention have been illustrated and described herein, it is not to be limited to the specific forms of arrangements of parts described and shown.

I claim:

1. In combination:

(A) a vertical blind assembly which includes
  (1) a headrail mounted on a wall adjacent to a window.
  (2) a plurality of vertically oriented slats pendently supported from said headrail and spaced from said window to define a gap; and (B) a gap-bridging assembly which includes
  (1) a bracket assembly which has
    (a) an L-shaped body having a short leg and a long leg,
    (b) said short leg having adhesive on one surface attaching said short leg to a rear surface of the headrail,
    (c) said long leg extending from said headrail and contacting said wall,
    (d) said long leg including
      (i) an elongated slot,
      (ii) two spaced apart mounting projections, and
      (iii) a U-shaped section having two legs and projection-receiving slots defined in said legs which slidably receive said spaced apart mounting projections,
  (2) a J-shaped hook slidably mounted on said long leg in said elongated slot, said hook including a top portion and a curved bottom portion, and a T-shaped projection mounted on said body portion, said T-shaped projection including a body attached at one end to said hook top portion and extending through said long leg elongated slot and a cap portion on said body that engages said long leg adjacent to said long leg slot on a side of said long leg that is opposite to the side on which said hook is located; and
  (3) an elongated gap-bridging vane having a hook-receiving slot defined in one and extending from said L-shaped bracket body between said vertical blind slats and said wall in said gap and being oriented to be perpendicular to a plane containing said wall, said vane being pendently supported from said hook for movement therewith.

2. The combination defined in claim 1 wherein headrail has a width and said L-shaped body includes a top edge and a bottom edge and has a width as measured between said top and bottom edges, said L-shaped body width is less than said headrail width.

3. The combination defined in claim 2 wherein said long leg includes an edge that abuts said wall, and further including adhesive on said long leg wall abutting edge.

4. The combination defined in claim 3 further including a pair of slots defined in said long leg to perpendicularly intersect said long leg elongated slot.

5. The combination defined in claim 4 wherein said pair of slots are defined adjacent to an insection of said long leg and said short leg.

* * * * *